US006196301B1

(12) United States Patent
Sabin

(10) Patent No.: US 6,196,301 B1
(45) Date of Patent: Mar. 6, 2001

(54) DEVICE FOR INJECTING PRESSURIZED FLUIDS INTO A MULTIPLATE HEAT EXCHANGER AND METHOD OF CLEANING SUCH AN INJECTION DEVICE

(75) Inventor: Dominique Sabin, Herbeville (FR)

(73) Assignee: Packinox, Paris (FR)

( * ) Notice: Subject to any disclaimer, the term of this patent is extended or adjusted under 35 U.S.C. 154(b) by 0 days.

(21) Appl. No.: 09/073,933

(22) Filed: May 7, 1998

(30) Foreign Application Priority Data

May 9, 1997 (FR) ..... 97 05736

(51) Int. Cl.[7] ..... F28G 19/01
(52) U.S. Cl. ..... 165/95; 165/119; 210/411
(58) Field of Search ..... 165/95, 97, 119; 210/411, 459; 137/239

(56) References Cited

U.S. PATENT DOCUMENTS 1,536,415 * 5/1925 Beck et al. ..... 137/239
3,941,697 3/1976 Johnson .
4,271,019 * 6/1981 Galletti ..... 210/411 X
4,413,675 * 11/1983 Gano ..... 165/119
4,612,116 * 9/1986 Hindman et al. ..... 210/411 X
5,190,095 * 3/1993 Fujimoto et al. ..... 165/95 X

FOREIGN PATENT DOCUMENTS 26 13 835 10/1976 (DE) .
0 343 531 11/1989 (EP) .
0 670 464 9/1995 (EP) .
2 697 906 5/1994 (FR) .
1 207 919 10/1970 (GB) .

* cited by examiner

*Primary Examiner*—Leonard Leo
(74) *Attorney, Agent, or Firm*—Pollock, Vande Sande & Amernick, R.L.L.P.

(57) ABSTRACT

A device for injecting pressurized fluids into a multiplate heat exchanger, comprising a leaktight chamber (2) provided with an arrangement for feeding and discharging a first pressurized fluid, a plate pack (1) placed in the chamber (2) and including channels for the flow of this first fluid mixed with a second pressurized fluid, and at least one nozzle (21) for injecting the second fluid. The nozzle (21) is connected to a pipe (22) for feeding the second fluid and to a pipe (24) for discharging the particles deposited on a filter unit placed inside the nozzle (21) downstream of the point where the two pipes (22, 24) join the nozzle (21) with respect to the direction of flow of the second fluid. The invention also relates to a method for cleaning such an injection device.

9 Claims, 3 Drawing Sheets

DEVICE FOR INJECTING PRESSURIZED FLUIDS INTO A MULTIPLATE HEAT EXCHANGER AND METHOD OF CLEANING SUCH AN INJECTION DEVICE

FIELD OF THE INVENTION

The subject of the present invention is a device for injecting pressurized fluids into a multiplate heat exchanger and to a method for cleaning such an injection device.

BACKGROUND OF THE INVENTION

Multiplate heat exchangers are generally formed by a leaktight chamber and by a plate pack placed in the said leaktight chamber and leaving a free space between them.

The plate pack is composed of a stack of mutually parallel plates leaving, between them, independent fluid flow circuits.

The plates, made of thin sheet metal, usually stainless steel or any other sufficiently ductile material, have edges with a smooth surface and a central part provided with corrugations by means of which they are in contact with one another and by means of which they delimit channels forming independent fluid flow circuits from one end of the heat exchanger to the other.

This type of heat exchanger with a plate pack operates with various fluids, in one-phase or two-phase mode.

If the charge to be heated is introduced into the exchanger in two-phase mode, it is necessary to mix the liquid and gas intimately so as to ensure uniform distribution of the mixture throughout the plate pack of the heat exchanger.

In order to ensure that the liquid and gas are intimately mixed, a device for injecting only the liquid phase is used.

This injection device consists of one or more nozzles which extend over the entire width of the plate pack and are provided with an open first end connected to pressurized-fluid feed means and with a closed second end.

The nozzle is generally placed in the lower part of the plate pack, and its axis is perpendicular to the channels of the said plate pack.

Moreover, the nozzle has calibrated holes for spraying the liquid into the channels of the plate pack, along generatrices and extending over the entire length of the nozzle.

The pressurized liquid enters the nozzle at one end and is sprayed upwards across the channels of the plate pack.

This pressurized liquid is then taken up by the gas, which flows at high speed, at the inlet of the plate pack, mixes intimately with the gas and flows, mixed with the gas, through the plate pack.

The two-phase mixture thus created is advantageously distributed over the entire width of the channels and is then entrained by the gas as far as the top of the plate pack.

This type of injection device perfectly fulfils the main function for which it was designed, namely, to ensure intimate mixing between the mixture and the gas and, consequently, to create the conditions for homogeneous and uniform distribution of the two-phase mixture as soon as it enters the plate pack.

A major drawback resides in the fact that the calibrated holes in the injection nozzles may be partially or completely blocked because of the presence in the liquid of particles or debris, for example metal particles or debris, despite the presence of filters inside the feed pipe for the liquid.

Thus, the operation of the heat exchanger is disturbed and its performance gradually deteriorates.

The injection nozzles must therefore be able to be cleaned regularly and, to accomplish this, the entire plant is shut down in order to be able to remove these injection nozzles and to clean them.

The operations of dismantling and cleaning the injection nozzles, and of refitting them, require, on average, shutting down the plant for one week.

SUMMARY OF THE INVENTION

The object of the invention is to avoid these drawbacks, while at the same time maintaining the efficiency of the injection device.

The subject of the invention is therefore a device for injecting pressurized fluids into a multiplate heat exchanger of the type comprising:

a leaktight chamber provided with means for feeding and discharging a first pressurized fluid, a plate pack placed in the chamber and composed of a stack of plates which leave, between them, channels for the flow of this first fluid mixed with a second pressurized fluid, as well as for the flow of a heat-transfer fluid, and at least one nozzle, for injecting the second fluid, which is provided with calibrated holes and extends over the entire width of the plate pack, wherein the nozzle has a closed end and an open end which is connected to a pipe for feeding the second fluid, the pipe being provided with a shut-off means, and is further connected to a pipe for discharging the particles deposited on a filter unit placed inside the nozzle downstream of the point where the pipes join the nozzle with respect to the direction of flow of the second fluid, the discharge pipe being provided with a shut-off means.

According to other characteristics of the invention:

the filter unit is flat and extends perpendicular to the axis of the injection nozzle, the filter unit has the shape of a pocket whose opening is directed towards the upstream end of the injection nozzle, the pocket is conical in shape, the filter unit is formed by a rigid support provided with holes and fixed to the internal wall of the injection nozzle, and by a fine-mesh filter pressed against that face of the rigid support which runs counter to the direction of flow of the second fluid, the filter unit is formed by a rigid support provided with holes, the fine-mesh filter is removably fitted onto the rigid support, and the discharge pipe is placed along the axis of the nozzle for injecting the second fluid.

Another subject of the invention is a method of cleaning a pressurized-fluid injection device of this type. This method consists, during the operation of the multiplate exchanger, in cutting the supply of the second fluid by shutting off the pipe for feeding this second fluid, in opening the discharge pipe and in making the first fluid pass through the injection nozzle in the opposite direction to the direction of flow of the second fluid in order to dislodge the particles deposited on the filter unit and to discharge them via the discharge pipe.

BRIEF DESCRIPTION OF THE DRAWINGS

The characteristics and advantages of the invention will appear in the course of the description which follows, given by way of example and with reference to the appended drawings, in which.

DETAILED DESCRIPTION OF THE PREFERRED EMBODIMENT

Figure 1:
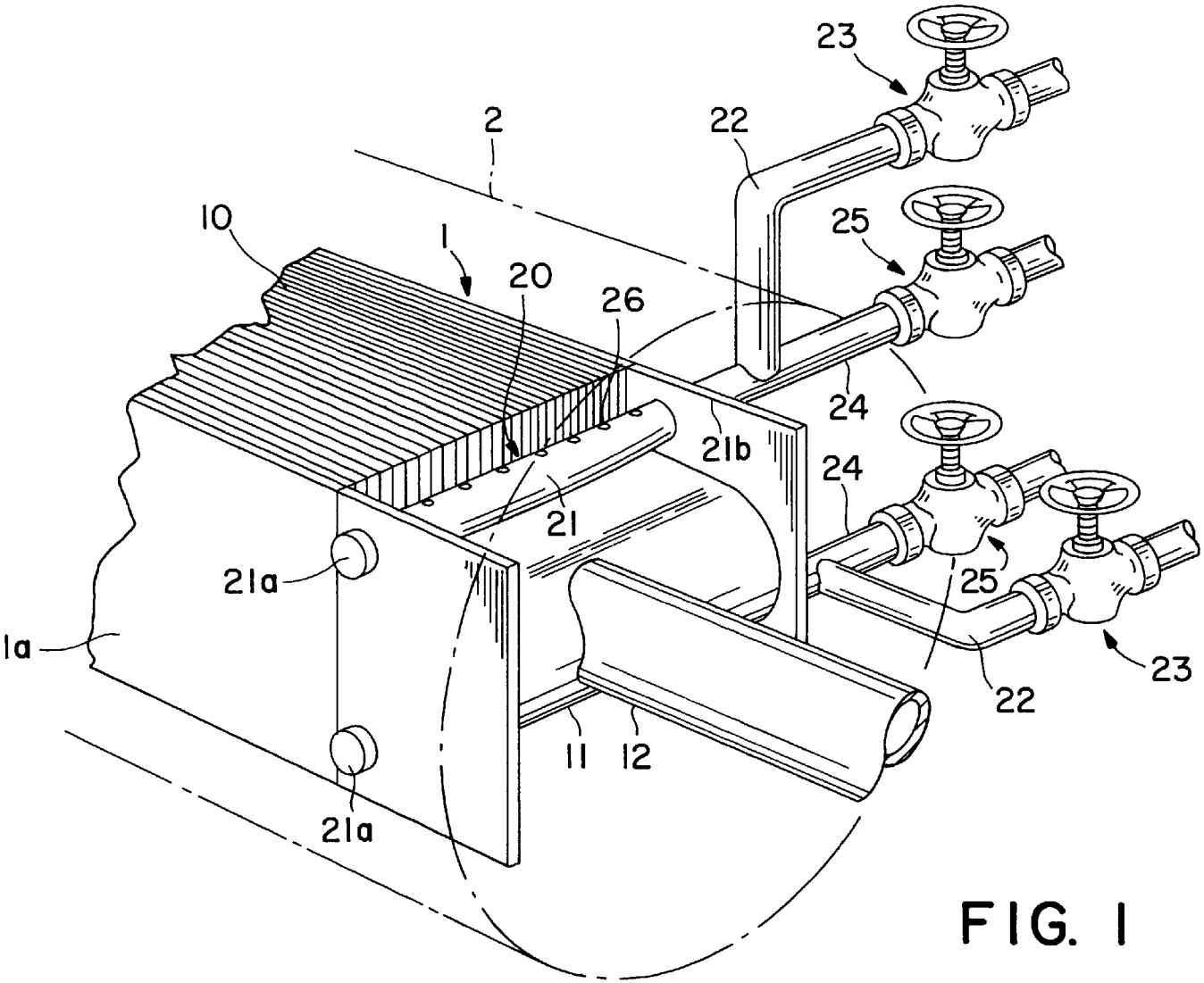
FIG. 1 is a partial schematic view, in perspective, of a multiplate heat exchanger provided with an injection device according to the invention.
Figure 2:
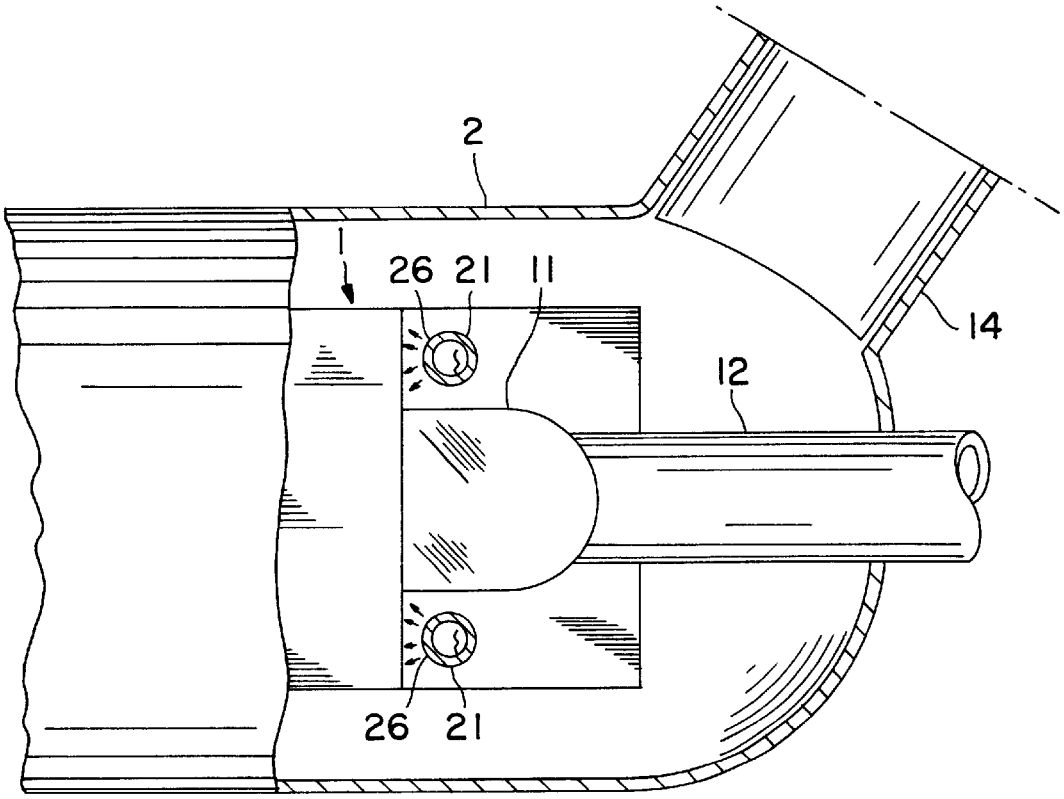
FIG. 2 is a schematic view in partial cross-section on the line 2—2 shown in FIG. 1.

FIGS. 1 and 2 show schematically only part of a heat exchanger, which is composed of a plate pack 1 placed inside a leaktight chamber 2.

Conventionally, the plate pack 1 is formed by a multitude of plates arranged contiguously and so as to be mutually parallel.

The plates 10, made of thin sheet metal, usually stainless steel or any other sufficiently ductile material, have edges with a smooth surface and a central part provided with corrugations by means of which they are in contact with one another and by means of which they delimit, in the embodiment illustrated in the drawings, a double circuit for fluids to flow independently as countercurrents from one end of the multiplate exchanger to the other.

The plate pack 1 has, at its lower end, an outlet manifold 11 for a heat-transfer fluid, this nozzle being connected to one of the circuits in plate pack 1 as well as to a pipe 12 for discharging the said heat-transfer fluid.

This heat-transfer fluid is introduced into the corresponding circuit in the plate pack 1 via the upper end of the plate pack.

The fluid to be heated, which in the present case consists of a mixture of a first fluid formed by a gas and by a second fluid formed by a liquid, is introduced via the lower end of the plate pack 1.

This fluid to be heated flows through the other circuit in the plate pack 1 as a countercurrent to the heat-transfer fluid.

For this purpose, the leaktight chamber 2 is connected to a pipe 14 for introducing the first fluid, i.e., gas, into the corresponding circuit in the plate pack, as illustrated in FIG. 2.

This first fluid therefore flows in the channels of the corresponding circuit in the plate pack 1 and in the free space left between plate pack 1 and the leaktight chamber 2.

Moreover, the heat exchanger includes a device 20 for injecting the second fluid, i.e., liquid, into the channels of the corresponding circuit.

The device 20 for injecting the second fluid, consisting of the liquid, includes, in the embodiment illustrated in FIGS. 1 and 2, parallel nozzles 21 placed on each side of the manifold 11.

The following description will be limited to a nozzle 21, the other nozzle being identical.

The nozzle 21 has its axis perpendicular to the channels of the corresponding circuit in the plate pack 1 and extends over the entire width of the plate pack 1.

The nozzle 21 has a closed first end 21*a* and an open second end 21*b* which is connected to a pipe 22 for feeding the second fluid, the pipe 22 being provided with a shut-off and isolating means 23 consisting, for example, of a valve.

The nozzle 21 is also connected to a pipe 24 for discharging the particles or debris and is provided with a shut-off or isolating means 25 consisting, for example, of a valve.

The pipe 22 is connected to means, not illustrated, for feeding the second pressurized fluid, and the discharge pipe 24 is preferably located on the axis of the nozzle 21.

This nozzle 21 has calibrated holes 26 for spraying the second pressurized fluid into the channels of the corresponding circuit in the plate pack 1, these holes being distributed along generatrices and over the entire length of the nozzle 21.

Figure 3:
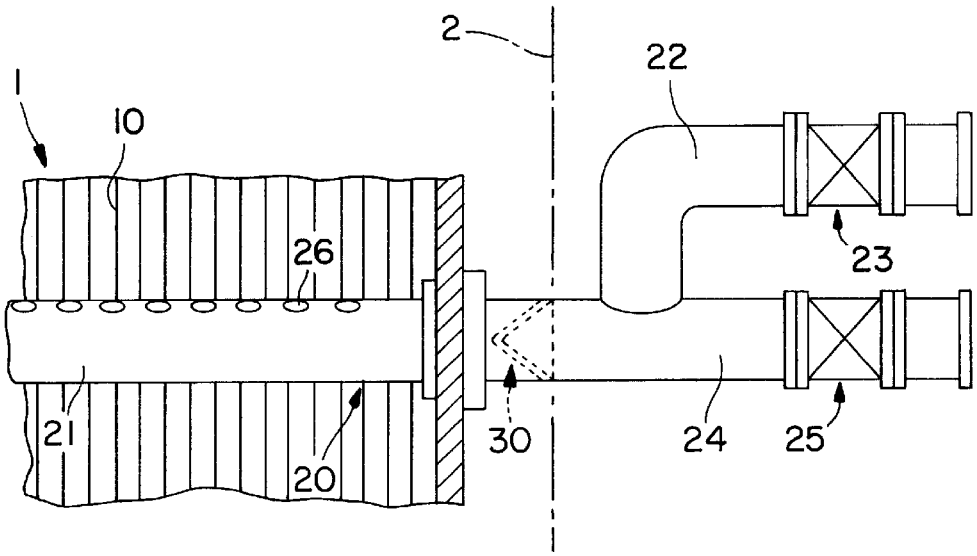
FIG. 3 is a schematic view of a nozzle of the injection device according to the invention.
Figure 4:
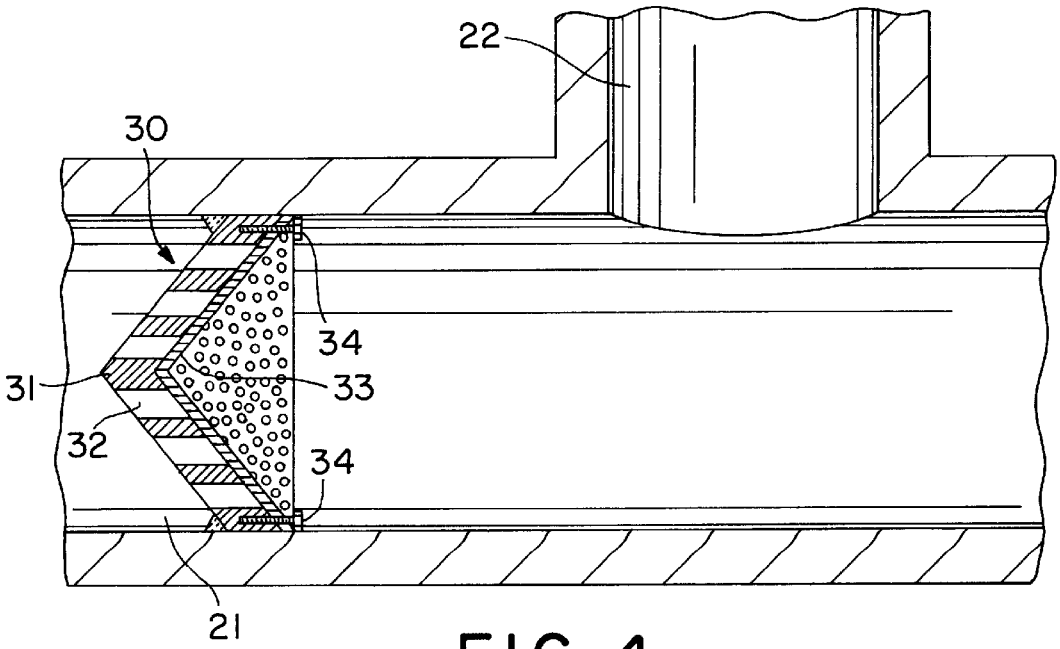
FIG. 4 is a schematic view, in cross-section and on a larger scale, of a filter unit of the injection device according to the invention.

As illustrated in FIGS. 3 and 4, the nozzle 21 includes a filter unit 30 placed downstream of the point where the pipes 22 and 24 join the nozzle 21 with respect to the direction of flow of the second fluid in the nozzle 21.

As illustrated more particularly in FIG. 4, the filter unit 30 has the shape of a pocket whose opening is directed towards the upstream end of the nozzle 21 for injecting the second fluid.

According to a preferred embodiment, the pocket of the filter unit 30 is conical in shape.

According to another embodiment, the filter unit 30 is flat and extends perpendicular to the axis of the injection nozzle 21.

The filter unit 30 is formed by a rigid support 31 provided with holes 32 and fixed, for example by welding, to the internal wall of the nozzle 21, and by a fine-mesh filter 33 pressed against that face of the rigid support 31 which runs counter to the direction of flow of the second fluid through the injection nozzle 21.

The thickness of the rigid support 21 is sufficient to be able to withstand the pressure of the second fluid, even if the fine-mesh filter 33 is completely blocked.

The mesh cells of the filter 33 are approximately 500 to 800 microns in size.

This fine-mesh filter 33 is removably fitted onto the support 31 by means of fixing devices 34 consisting, for example, of screws.

According to an alternative embodiment, the filter unit 30 is formed only by the rigid support 31 provided with holes 32.

In normal operation, the discharge pipe 24 is closed by the valve 25 and the second fluid, consisting of the liquid, is supplied via the feed pipe 22, passes through the valve 23, which is in the open position, and emerges in the injection nozzle 21.

The second pressurized fluid is therefore sprayed towards the top of the plate pack 1 through the set of calibrated holes 26.

This second pressurized fluid is then taken up by the first fluid, which flows at high speed, at the inlet of the plate pack 1, mixes intimately with the first fluid and flows, intimately mixed with the first fluid, through the channels of the corresponding circuit in the plate pack 1.

The two-phase mixture thus created is advantageously distributed over the entire width of these channels and is then entrained as far as the top of the plate pack 1.

During operation of the heat exchanger, particles or debris, usually consisting of iron oxides, are entrained during flow of the second fluid and form a plug which gradually completely obstructs the fine-mesh filter 33.

Thus, the operation of the heat exchanger is disturbed and its performance gradually deteriorates.

Should the fine-mesh filter 33 or even the calibrated holes 26 of each injection nozzle 21 become blocked, these nozzles 21 are cleaned without stopping the operation of the plant, including the heat exchanger.

To this end, the supply of the second fluid is cut, by closing the valves 23, and the valves 25 on the discharge pipes 24 are opened.

The first fluid, consisting of the gas, which is at high pressure in the leaktight chamber 2, enters nozzles 21 via the holes 26, exerts a pressure in these nozzles 21, passes through the holes 32 in the rigid supports 31 and emerges in the fine-mesh filters 33.

The debris or particles that have accumulated inside the nozzle 21 and have become agglutinated against the fine-mesh filters 33 are immediately flushed away via the discharge pipes 24 for these particles or debris.

Given the pressure of the first fluid existing in the leaktight chamber 2, which is of the order of 5 to 20 bar and may be as much as 30 bar, the nozzles 21 and the fine-mesh filters 33 are cleaned immediately.

Thus, this cleaning operation is carried out without interrupting the operation of the heat exchanger.

Each discharge pipe 24 may be connected to a tank for recovering the particles or debris.

After this cleaning operation, each discharge pipe 24 is isolated by closing the valves 25, and the valves 23 are reopened for feeding the second fluid into the injection nozzles 21.

The entire operation of cleaning the injection nozzles 21 is performed in a very short time, of the order of a few minutes, whereas in the past, cleaning of these nozzles 21 required time to be dismantled and the plant shut down for approximately one week.

What is claimed is:

1. A device for injecting pressurized fluids into a multiplate heat exchanger comprising:

a leaktight chamber (2) provided with means for feeding and discharging a first pressurized fluid, a plate pack (1) placed in said chamber (2) and composed of a stack of plates (10) separated by channels for a flow of said first fluid mixed with a second pressurized fluid, and of a heat-transfer fluid, and at least one nozzle (21), for injecting said second fluid, said nozzle being provided with calibrated holes (26) and extending over an entire width of said plate pack (1), wherein said nozzle (21) has a closed end (21*a*) and an open end (21*b*) which is connected to a pipe (22) for feeding said second fluid, said pipe (22) being provided with a shut-off means (23), and further being connected to a pipe (24) for discharging particles deposited on a filter unit (30) located within said nozzle (21) downstream of a junction point of said pipes (22, 24), said discharge pipe (24) being provided with a shut-off means (25).

2. The device according to claim 1, wherein said filter unit (30) is flat and extends perpendicular to an axis of said nozzle (21).

3. The device according to claim 1, wherein said filter unit (30) has a shape of a pocket having an opening directed in an upstream direction of said nozzle (21).

4. The device according to claim 3, wherein said pocket is conical in shape.

5. The device according to claim 1, wherein said filter unit (30) comprises a rigid support (31) provided with holes (32) and fixed to an internal wall of said nozzle (21), and a fine-mesh filter (33) pressed against a face of said rigid support (31) which runs counter to a flow direction of said fluid.

6. The device according to claim 5, wherein said fine-mesh filter (33) is removably fitted onto said rigid support (31).

7. The device according to claim 1, wherein said filter unit (30) is formed by a rigid support (31) provided with holes (32).

8. The device according to claim 1, wherein said discharge pipe (24) is placed along an axis of the nozzle (21) for injecting said second fluid.

9. A method for cleaning a pressurized-fluid injection device according to claim 1, said method comprising the steps of (a) during operation of said multiplate heat exchanger, cutting a supply of said second fluid by shutting off said pipe (22) for feeding said second fluid;

(b) opening said discharge pipe (24); and (c) causing said first fluid to pass through said nozzle (21) in a direction opposite to a direction of flow of said second fluid in order to dislodge particles deposited on said filter unit (30) and to discharge said particles via said discharge pipe (24).

* * * * *